US007275523B2

(12) United States Patent
Kimura et al.

(10) Patent No.: US 7,275,523 B2
(45) Date of Patent: Oct. 2, 2007

(54) FUEL SUPPLY UNIT IN FUEL TANK FOR MOTORCYCLE

(75) Inventors: Jun Kimura, Kanagawa (JP); Mitsuyuki Nakagawa, Kanagawa (JP)

(73) Assignee: Keihin Corporation, Tokyo (JP)

( * ) Notice: Subject to any disclaimer, the term of this patent is extended or adjusted under 35 U.S.C. 154(b) by 34 days.

(21) Appl. No.: 11/283,810

(22) Filed: Nov. 22, 2005

(65) Prior Publication Data

US 2007/0113832 A1 May 24, 2007

(51) Int. Cl.
*F02M 37/04* (2006.01)

(52) U.S. Cl. ..... 123/509; 123/510

(58) Field of Classification Search ..... 123/509, 123/495, 510; 180/219
See application file for complete search history.

(56) References Cited

U.S. PATENT DOCUMENTS 6,907,865 B1 * 6/2005 Hanby ..... 123/509
2001/0018932 A1 * 9/2001 Tokunaga ..... 137/565.34
2002/0038653 A1 * 4/2002 Kobayashi et al. ..... 123/509
2004/0200652 A1 * 10/2004 Hara et al. ..... 180/219
2005/0126546 A1 * 6/2005 Yagisawa ..... 123/509
2005/0201877 A1 * 9/2005 Mitsudou ..... 417/423.14

* cited by examiner

*Primary Examiner*—Carl S. Miller
(74) *Attorney, Agent, or Firm*—Bacon & Thomas, PLLC

(57) ABSTRACT

To decrease height of a center tank chamber of a fuel tank for a motorcycle, the tank is formed to have a center tank chamber, and one side and another side tank chambers comprising an inclined parts extending to lower sides of one side and another side from a bottom part of the center tank chamber respectively, a fuel supply unit, where a fuel pump having a fuel filter on the low pressure side is attached to a closing plate through a supporting body 2, is inserted into the fuel tank from a unit inserting hole at the bottom part, a longitudinal axial line of the fuel pump is arranged along the inclined part, and a pump suction passage is provided in the one side tank chamber positioned lower than the bottom part.

3 Claims, 2 Drawing Sheets

FUEL SUPPLY UNIT IN FUEL TANK FOR MOTORCYCLE

BACKGROUND OF THE INVENTION

1. Field of the Invention

The present invention relates to a fuel injection device, where fuel in a fuel tank is pressurized by a fuel pump to be supplied to an engine through a fuel injection valve. More particularly, the present invention relates to a mounting structure of a fuel supply unit on a fuel tank for a motorcycle.

2. Description of the Conventional Art

One side of the fuel tank for a motorcycle is indicated in Japanese Patent Application Laid Open No. 61 (1986)-81874.

In this publication, a main pipe is provided along the running direction of a motorcycle, and the fuel tank having an inverse U-shaped cross-sectional shape is mounted so as to straddle the main pipe from the top side.

This fuel tank is explained further with simplified FIG. 2 and FIG. 3. In FIG. 3, a fuel tank T has a center tank chamber T1, one side tank chamber T2 and another side tank chamber T3. The center tank chamber T1 is formed in a center part in the cross section. The one side tank chamber T2 is formed from a bottom part T1*a* of the center tank chamber T1 toward the lower side of one side A. The other side tank chamber T3 is formed from the bottom part T1*a* toward the lower side of another side B.

That is, the fuel tank T is formed to have an inverse U shape with the center tank chamber T1, and the one side tank chamber T2 and the other side tank chamber T3, which are formed on the both sides of the center tank chamber T1. Further, the bottom part T1*a* of the center tank chamber T1 is provided along the upper side of a main pipe M.

In other words, the one side tank chamber T2 and the other side tank chamber T3 are provided facing each other on the both sides of the main pipe M.

On the other hand, in the fuel injection device, the fuel supply unit is formed by fixedly providing a fuel pump, a fuel filter on the low pressure side or the like on a base member, and attached toward the inside of the fuel tank.

Such a fuel supply device is vertically provided from the bottom part T1*a* of the center tank chamber T1 to the inside of the center tank chamber T1, as indicated in Japanese Patent Application Laid Open No. 2002-293281 and 11 (1999)-93794.

SUMMARY OF THE INVENTION

According to such the conventional fuel supply unit attached to the fuel tank for a motorcycle, the designing freedom of the fuel tank is remarkably prevented, and the designing freedom of the motorcycle is also limited. Thus, the merchantability of the motorcycle cannot be enhanced.

That is, in the fuel tank for a motorcycle, a height H of the center tank chamber T1 is positioned on the front side of a rider, so that it is set comparatively small. However, as the fuel supply unit is provided in the center tank chamber T1, it is necessary to increase the height H of the center tank chamber T1.

Thus, it is hard to freely set the shape of the fuel tank, so that the merchantability of the motorcycle cannot be enhanced.

When the height H of the center tank chamber is increased, an upper part T1*b* of the center tank chamber T1 is upwardly projected. Thus, when a rider gets on the motorcycle, the projected upper part T1*b* is positioned in front of the rider's body, so that the position of the projected upper part T1*b* is remarkably worried for the rider.

The present invention solves the above-mentioned problems, and an objective of the present invention is to provide the fuel supply unit in the fuel tank for a motorcycle, which is capable of lowering the height of the center tank chamber having the approximately inverse U-shaped cross section, capable of increasing the designing freedom of the fuel tank, and thereby especially suitable to a motorcycle.

One aspect of a fuel supply unit in a fuel tank for a motorcycle according to the present invention is as follows. The fuel supply unit is housed in the fuel tank for a motorcycle, which has an approximately inverse U-shaped cross-section and comprises a center tank chamber formed along the running direction of the motorcycle; one side tank chamber formed to have an inclined part extending to the lower side of one side from the bottom part of the center tank chamber T; and another side tank chamber formed to have an inclined part extending to the lower side of another side from the bottom part of the center tank chamber. In the fuel supply unit, a fuel pump comprising at least a fuel filter on the low pressure side is attached to a closing plate for closing a unit inserting hole, which is provided on a bottom part of the center tank chamber, through a supporting body. The fuel pump is provided in the one side tank chamber, and a longitudinal axial line of the fuel pump is arranged along an inclined part of the one side tank chamber. Further, a pump suction passage of the fuel pump is opened facing to the bottom part in the one side tank chamber positioned on the lower side of the bottom part of the center tank chamber. Additionally, the fuel filter on the low pressure side is arranged in the one side tank chamber along the inclined part of the one side tank chamber at a lower position than the bottom part of the center tank chamber and is further arranged between the inclined part of the one side tank chamber and the fuel pump along the longitudinal axial line of the fuel pump.

Further, another aspect of the fuel supply unit in addition to the above one aspect is as follows. The fuel filter on the low pressure side is mounted on the pump suction passage of the fuel pump, and is provided in the one side tank chamber at a lower position than the bottom part of the center tank chamber and along the inclined part of the one side tank chamber.

Furthermore, another aspect of the fuel supply unit in addition to the above one aspect is as follows. A pump discharge passage of the fuel pump is connected with a fuel discharge pipe provided in the fuel tank and is opened toward the outside from the closing plate by an opening part. Further, the fuel discharge pipe is formed with a horizontal fuel discharge pipe extending to the pump discharge passage and a vertical fuel discharge pipe extending to the opening part.

According to the one aspect of the present invention, the fuel pump is attached to the closing plate through the supporting body, and inserted into the one side tank chamber of the fuel tank through the unit inserting hole at the bottom part to be provided therein. In this state, the closing plate closes the unit inserting hole, and is fixed at the bottom part of the fuel tank.

The fuel pump sucks and pressurizes the fuel in the one side tank at the lower position than the bottom part of the center tank chamber. Then, the pressurized fuel is discharged to the outside from the pump discharge passage through the fuel discharge pipe.

According to the one aspect of the present invention, the longitudinal axial line of the fuel pump is arranged along the inclined part of the one side tank chamber, and the pump suction passage of the fuel pump is opened facing to the bottom part in the one side tank chamber at the lower position than the bottom part of the center tank chamber. Thus, the height of the pump discharge passage corresponding to the upper end of the fuel pump can be arranged low, the position of the upper part of the fuel tank can be lowered. Thereby, the designing freedom of the fuel tank can be enhanced, and the designing plan of the motorcycle, where the fuel tank is directly exposed to the outside, is not limited.

Further, according to the other aspect of the present invention, the fuel filter on the low pressure side is provided in the one side tank chamber at the lower position than the bottom part of the center tank chamber, and is provided along the inclined part of the one side tank chamber. Then, the fuel tank is not remarkably projected toward the one side, and the fuel filter on the low pressure side can have a large filtration area along the inclined part.

Further, the fuel filter on the low pressure side is provided in the same direction of longitudinal axial line of the fuel pump. Thereby, the fuel pump and the fuel filter on the low pressure side can be easily inserted into the fuel tank through the unit inserting hole.

Furthermore, according to the other aspect of the present invention, the fuel pressurized by the fuel pump is discharge toward the outside through the pump discharge passage and the fuel discharge pipe.

In this structure, since the fuel discharge pipe connected with the pump discharge passage is connected with the horizontal fuel discharge pipe, the pump discharge pipe is not remarkably extended upward. Thus, the position of the upper part of the fuel tank can be lowered, so that it is preferable.

Further, the horizontal fuel discharge pipe is provided approximately in parallel with the closing plate for closing the unit inserting hole, so that the fuel discharge pipe including the fuel pump can be easily inserted into the fuel tank through the unit inserting hole.

DETAILED DESCRIPTION OF PREFERRED EMBODIMENT

Hereinafter, one example of the fuel supply unit in the fuel tank for a motorcycle according to the present invention is described with FIG. 1.

M is a main pipe extending toward the rear side from a head pipe (not illustrated) of a motorcycle, and the main pipe M is provided along the running direction of the motorcycle.

A fuel tank T storing fuel at the inside thereof is mounted on a body so as to be at the both sides of the main pipe M from the upper side. A lower part of the fuel tank is branched into two ways, and the cross section of the fuel tank T is formed to have an approximately inverse U shape.

The fuel tank T is described concretely.

T1 is a center tank chamber formed at the center part of the fuel tank T, and a bottom part T1*a* of the center tank chamber T1 is provided facing to the upper surface of the main pipe M.

That is, the center tank chamber T1 is formed along the longitudinal direction of the main pipe M. (The longitudinal direction of the main pipe M means the front and rear directions of the paper of FIG. 1.) Further, one side tank chamber T2 is formed from one side part T1*a*1 of the bottom part T1*a* of the center tank chamber T1 toward one side A (the right in FIG. The one side tank chamber has an inclined part T2*a* formed toward the lower side from the one side T1*a*1, a part bent upwardly from a bottom part T2*b* at a lower end thereof and a part formed extending to an upper part T1*b* of the center tank chamber T1.

Therefore, the one side tank chamber T2 extending to the center tank chamber T1 is formed in the one side A of the center tank chamber T1.

Figure 1:
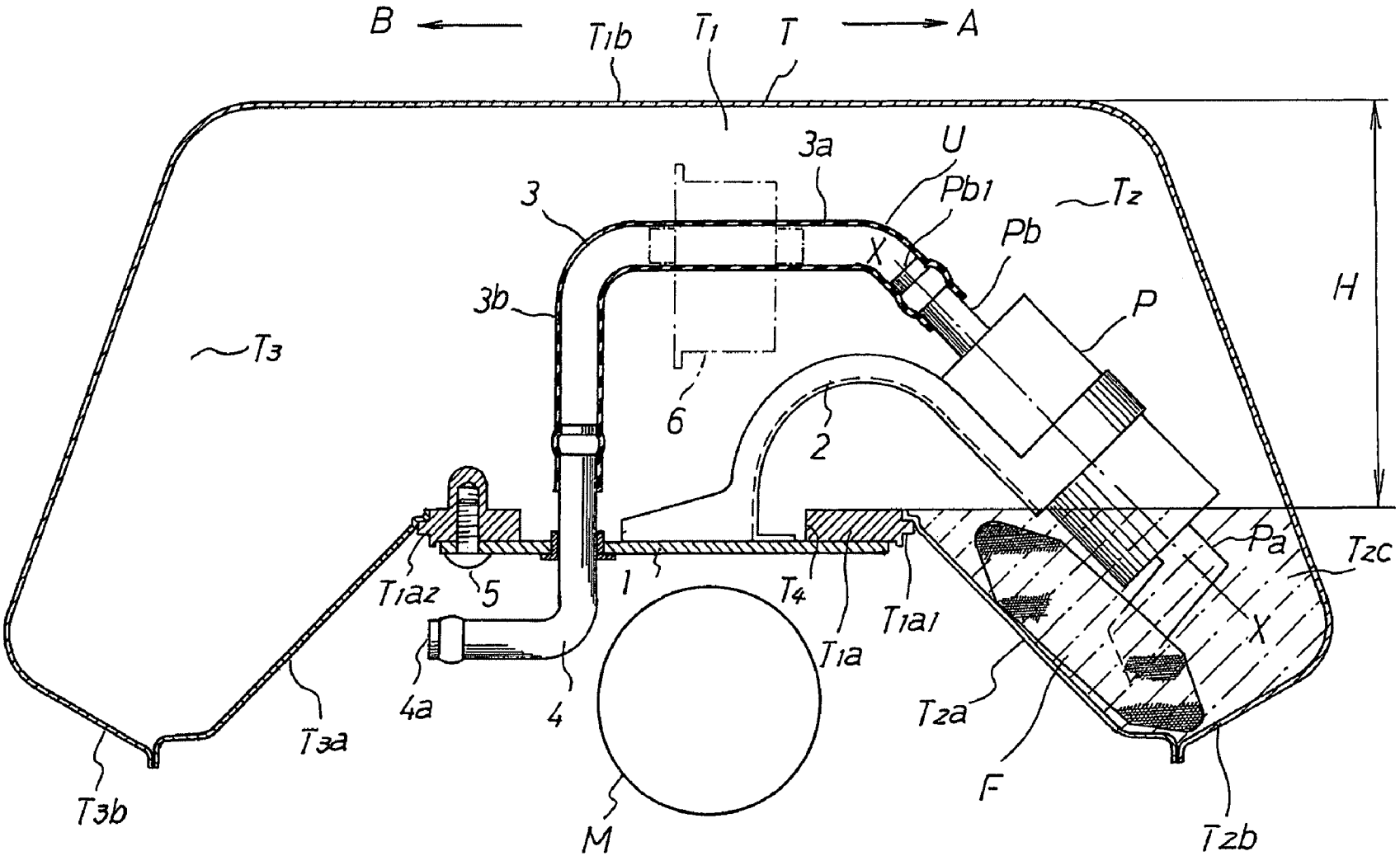
FIG. 1 is a primary part longitudinal sectional view illustrating one example of a fuel supply unit in a fuel tank for a motorcycle according to the present invention.
Figure 2:
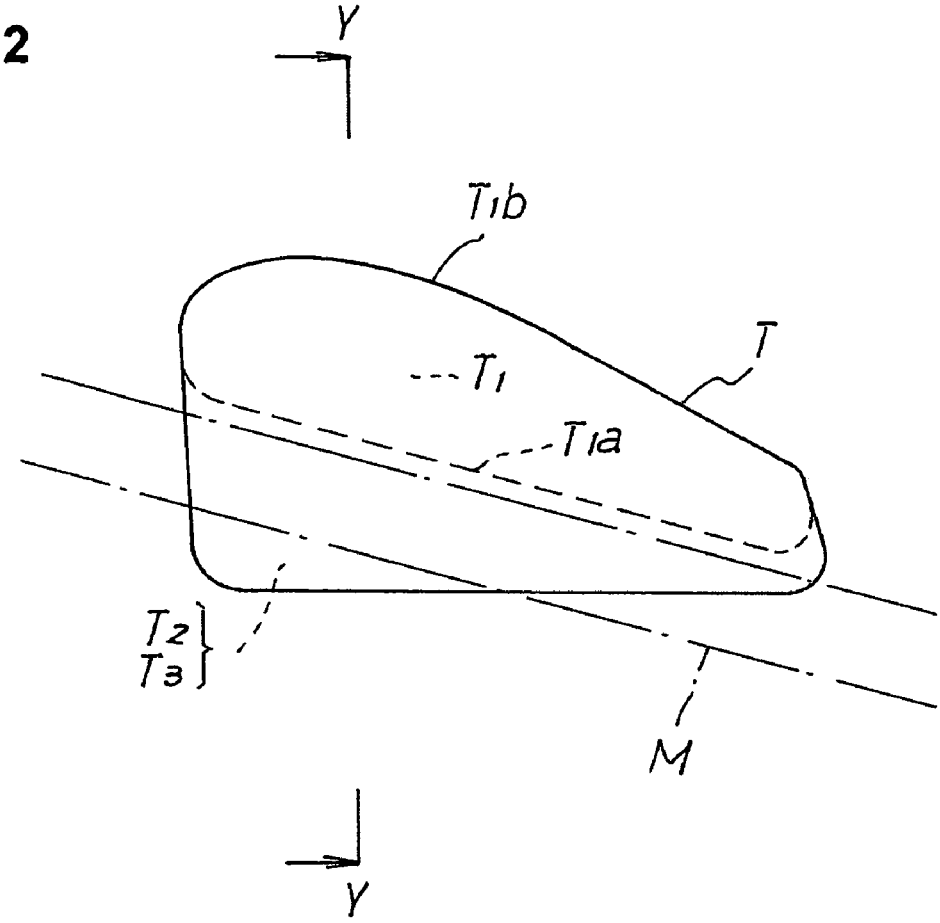
FIG. 2 is a side view illustrating the fuel tank for a motorcycle formed to have an inverse U shape.
Figure 3:
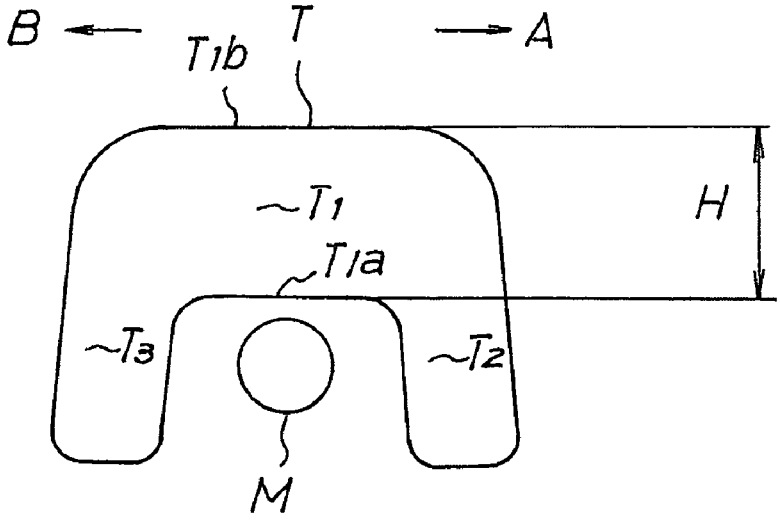
FIG. 3 is a longitudinal sectional view along line Y-Y in FIG. 2.

On the other hand, another side tank chamber T3 is formed from another side part T1*a*2 of the bottom part T1*a* of the center tank chamber T1 toward another side B (the left in FIG. 1).

The other side tank chamber has an inclined part T3*a* formed toward the lower side from the other side T1*a*2 of the bottom part T1*a*, a part bent upwardly from a bottom part T3*b* of a lower end thereof and a part formed extending to the upper part T1*b* of the center tank chamber T1.

Therefore, the other side tank chamber T3 extending to the center tank chamber T1 is formed in the other side B of the center tank chamber T1.

Then, the fuel tank T has the center tank chamber T1 formed at the center part, the one side tank chamber T2 is formed in the one side A of the center tank chamber T1, and the other side tank chamber T3 is formed in the other side B of the center tank chamber T1. The cross-sectional shape of the fuel tank T is formed to have the approximately inverse U shape.

Further, the center tank chamber T1 of the fuel tank T is provided along the longitudinal direction of the main pipe M, and the one side tank chamber T2 and the other side tank chamber T3 are provided at the both sides of on the main pipe M oppositely to each other.

Further, the lower side of the one side tank chamber T2 is formed with the inclines part T2*a* extending downwardly from the one side part T1*a* of the bottom part T1*a* and the bottom part T2*b*, so that it is formed on the lower position than the bottom part T1*a* of the center tank chamber T1.

Similarly, the lower side of the other tank chamber T3 is formed with the inclined part T3*a* extending downwardly from the other side part T1*a*2 of the bottom part T1*a* and the bottom part T3*b*, so that it is formed on the lower position than the bottom part T1*a* of the center tank chamber T1.

A fuel supply unit U is formed by the followings.

1 is a closing plate for closing a unit inserting hole 4 opened at the bottom part T1*a* of the center tank chamber T1, and a fuel pump P is attached to a supporting body 2 integrally attached to the closing plate 1.

Further, a fuel filter F on the low pressure side is attached on a pump suction passage Pa of the fuel pump P, a fuel discharge pipe 3 is connected with a discharge passage Pb of the fuel pump P, and the fuel discharge pipe 3 is opened to the outside at an opening part 4*a* of a pipe 4, which is fixedly provided at the closing plate 1.

Further, the fuel supply unit U, which comprises the fuel pump P attached to the supporting body 2 of the closing plate 1, the fuel filter F on the low pressure side, and the fuel discharge pipe 3, as mentioned above, is housed in the fuel tank T by the followings.

The fuel pump P is inserted from a unit inserting hole T4, while a longitudinal axial line x-x thereof is positioned in the vertical direction. Then, the fuel pump P is rotated clockwisely and inserted into the one side tank chamber T2. In this state, the closing plate 1 is screwed to the bottom part T1*a* of the fuel tank T with a screw 5, and thereafter the unit inserting hole 4 is closed with the closing plate 1.

Then, the longitudinal axial line x-x of the fuel pump P provided in the one side tank chamber T2 is arranged along the inclined part T2*a* which forms the one side tank chamber 2, and the pump suction passage Pa is provided so as to open and face to the bottom part T2*b* of the one side tank chamber T2*c*, where the bottom part T2*b* is at the lower position than the bottom part T1*a* of the fuel tank T. The one side tank chamber T2*c* is indicated by the alternate long and short dash line in FIG. 1.

According to the structure mentioned above, an upper end Pb1 of the pump discharge passage Pb, which is corresponding to the most upper end of the fuel pump P, can be provided low.

The reason of this is as follows. The longitudinal axial line x-x of the fuel pump P is inclined along the inclined part T2*a* where the one side tank chamber T2 is formed, and the fuel suction passage Pa is provided facing the bottom part T2*b* of the one side tank chamber T2*c* at the lower position than the bottom part T1*a* of the center tank chamber T1.

Then, the height H of the center tank chamber T1 can be decreased. Thereby, the designing freedom of the fuel tank can be enhanced, so that it is preferable on the design of the motorcycle.

Further, the fuel filter F on the low pressure side, which is connected with the pump suction passage Pa of the fuel pump P, is provided in the one side tank chamber T2*c* at the lower position than the bottom part T1*a* of the center tank chamber T1, and is provided along the inclined part T2*a* where the one side tank chamber T2 is formed. That is, the fuel filter F on the low pressure side is provided between the fuel pump P and the inclined part T2*a* and along the longitudinal axial line x-x of the fuel pump P. Then, the fuel filter F on the low pressure side is not projected toward the one side A, so that the one side tank chamber T2 can be made compact in the one side A.

Further, when the fuel pump P is inserted into the fuel tank T, the fuel pump P and the fuel filter F on the low pressure side can be inserted into the fuel tank from the unit inserting hole T4 in the coaxial state, so that mountability can be improved.

Furthermore, since the fuel filter F on the low pressure side is provided along the inclined part T2*a*, the large filtration area can be secured without extending the one side tank chamber T2*c* toward the one side A.

Further, the fuel discharge pipe 3 connecting the pump discharge passage Pb of the fuel pump P with the pipe 4 fixed at the closing plate 1 may be provided as follows.

The fuel discharge pipe 3 provided in the fuel tank T comprises the horizontal fuel discharge pipe 3*a* extending in the horizontal direction in the drawings, and the vertical fuel discharge pipe 3*b* bent downwardly from one end of the horizontal fuel discharge pipe 3*a*. Thus, the right end of the horizontal fuel discharge pipe 3*a* is connected with the pump discharge passage Pb, and the lower end of the vertical fuel discharge pipe 3*b* is connected with the pipe 4 opened in the fuel tank T.

In accordance with the structure mentioned above, the fuel discharged from the fuel pump P is supplied to the fuel injection valve (not illustrated in the drawings), through the pump discharge passage Pb, the horizontal fuel discharge pipe 3*a*, the vertical fuel discharge passage 3*b*, and the opening part 4*a* of the pipe 4.

In this structure, the fuel discharge pipe 3 is not remarkably extended upwardly, especially because the fuel discharge pipe 3 is connected with the pump discharge passage Pb by the horizontal fuel discharge pipe 3*a*. Thus, it can be prevented to increase the height H of the center tank chamber T1.

Further, a fuel filter 6 on the high pressure side may be provided at the fuel discharge pipe 3. At this time, it can be prevented to increase the height H of the center tank chamber T1 by providing the fuel filter 6 on the high pressure side at the horizontal fuel discharge pipe 3*a*.

What is claimed is:

1. A fuel supply unit in a fuel tank for a motorcycle, wherein the fuel tank for a motorcycle is formed in an approximately inverse U-shape in its cross section with a structure comprising:

a center tank chamber formed along a running direction of a motorcycle;

one side tank chamber formed with an inclined part extending from a bottom part of the center tank chamber toward the lower side of one side; and another side tank chamber formed with an inclined part extending from the bottom part of the center tank chamber toward the lower side of another side, a fuel pump, which has a fuel filter on the low pressure side and is connected to a pump suction passage, is attached to a closing plate for closing a unit inserting hole, which is provided on a bottom part of the center tank chamber, through a supporting body, a longitudinal axial line of the fuel pump is arranged in the one side tank chamber along an inclined part of the one side tank chamber, and the pump suction passage of the fuel pump is opened facing to the bottom part in the one side tank chamber at a lower position than the bottom part of the center tank chamber, and further, said fuel filter on the low pressure side is arranged on the one side tank chamber along the inclined part of the one side tank chamber at a lower position than the bottom part of the center tank chamber and is further arranged between the inclined part of the one side tank chamber and the fuel pump along the longitudinal axial line of the fuel pump.

2. The fuel supply unit in the fuel tank for a motorcycle as claimed in to claim 1, wherein the fuel filter on the low pressure side is mounted on the pump suction passage of the fuel pump.

3. The fuel supply unit in the fuel tank for a motorcycle as claimed in claim 1, wherein the pump suction passage of the fuel pump is connected with a fuel discharge pipe provided in the fuel tank and is opened toward the outside from the closing plate by an opening part, and the fuel discharge pipe is formed with a horizontal fuel discharge pipe extending to the pump suction passage and a vertical fuel discharge pipe extending to the opening part.

* * * * *